310-322 SR
7/24/84 XR 4,461,930

United States Patent [19]
Melillo et al.

[11] Patent Number: 4,461,930
[45] Date of Patent: Jul. 24, 1984

[54] ACOUSTIC TRANSDUCER WITH HONEYCOMB DIAPHRAGM

[75] Inventors: Louis Melillo, Crystal Lake, Ill.; Tsutomu Haga, Teppo; Iwao Sashida, Chichibushi, both of Japan

[73] Assignee: Pioneer Speaker Components, Inc., Arlington Heights, Ill.

[21] Appl. No.: 422,018

[22] Filed: Sep. 23, 1982

[51] Int. Cl.[3] ..... H04R 17/00
[52] U.S. Cl. ..... 179/110 A; 181/168; 310/322
[58] Field of Search ..... 179/110 A, 181 R, 181 F; 310/322; 181/168

[56] References Cited

U.S. PATENT DOCUMENTS

| | | | |
|---|---|---|---|
| 3,588,381 | 6/1971 | Schafft | 179/110 A |
| 3,749,855 | 7/1973 | Schafft | 179/110 A |
| 3,786,202 | 1/1974 | Schafft | 179/110 A |
| 3,970,879 | 7/1976 | Kumon | 179/110 A |
| 4,283,605 | 8/1981 | Nakajima | 179/110 A |
| 4,291,205 | 9/1981 | Kamon | 179/181 R |
| 4,344,503 | 8/1982 | Nakamura | 181/168 |
| 4,389,548 | 6/1983 | Morikawa | 179/110 A |

FOREIGN PATENT DOCUMENTS

| | | | |
|---|---|---|---|
| 54-12832 | 3/1979 | Japan | 179/181 R |
| 57-89396 | 6/1982 | Japan | 179/110 A |

*Primary Examiner*—Gene Z. Rubinson
*Assistant Examiner*—L. C. Schroeder
*Attorney, Agent, or Firm*—Richard P. Crowley

[57] ABSTRACT

An acoustic transducer having a honeycomb-type diaphragm material, which transducer comprises a piezoelectric element and a driving element supported within a housing frame and acoustically attached by a coupling means to a honeycomb-type diaphragm, flat sheet material having a high stiffness-to-weight ratio, to provide an acoustic transducer having an efficient, well-dispersed, frequency response of shallow design and improved heat conductivity.

20 Claims, 4 Drawing Figures

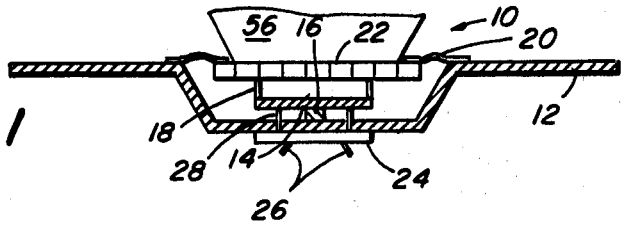
FIG. 1
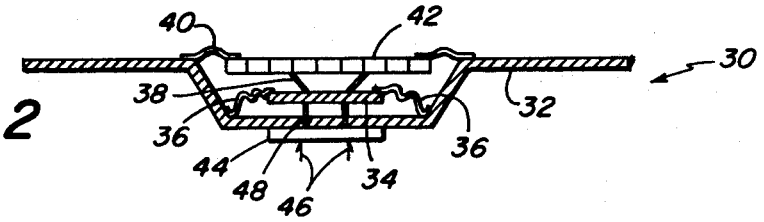
FIG. 2
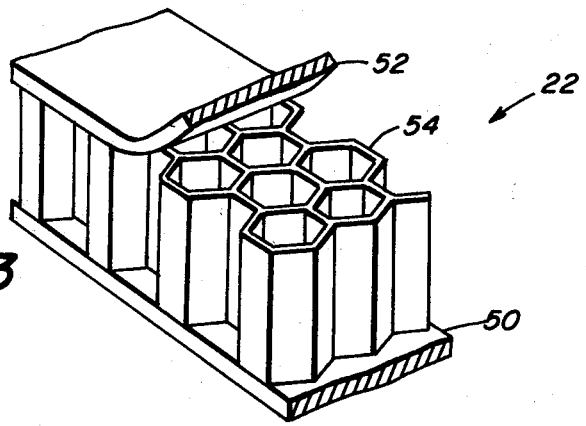
FIG. 3
FIG. 4
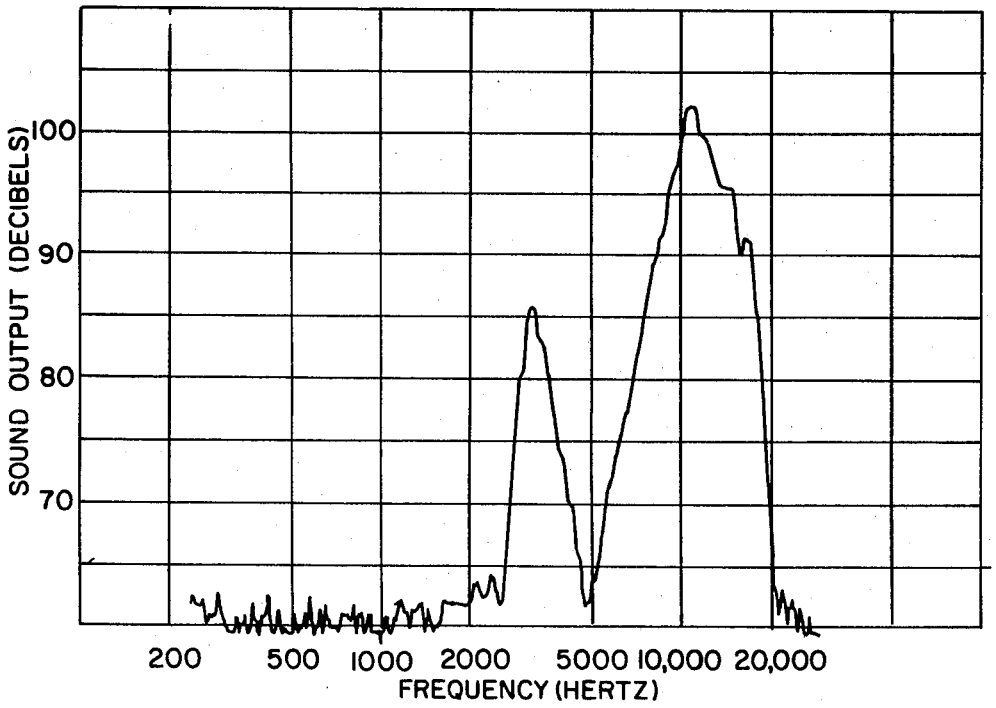

ACOUSTIC TRANSDUCER WITH HONEYCOMB DIAPHRAGMcl BACKGROUND OF THE INVENTION

Acoustical transducers provide for the conversion of energy between electrical and mechanical states and are particularly useful as speakers, such as high-frequency speakers, for converting electrical energy into acoustical energy. Typically, such speakers have a piezoelectric driving element acoustically coupled to a cone-type or dome-type diaphragm (see, for example, U.S. Pat. No. 3,548,116, issued Dec. 15, 1970, and U.S. Pat. No. 3,786,202, issued Jan. 15, 1974). Such diaphragms are usually constructed of a thin, somewhat fragile, compliant material, such as plastic or paper. The nature of the dome-like or cone-like diaphragm provides certain structural and geometric effects and constraints in the design of the speaker and in the use of the speaker in other devices.

Further, the construction and design of such prior-art speakers often do not permit the efficient, well-dispersed, frequency response desired in high-frequency speakers. Prior-art speakers, employing paper or plastic diaphragms, also have a reduced ability to dissipate heat, due to the low heat conductivity of the diaphragm material.

Thus, it is desirable to provide an improved, acoustical transducer which overcomes or improves on all or some of the limitations and constraints of prior-art transducers, and particularly high-frequency speakers.

SUMMARY OF THE INVENTION

This invention relates to an acoustic transducer having a diaphragm composed of a honeycomb material. More particularly, the invention concerns an acoustic transducer, such as a high-frequency speaker, having a piezoelectric driving element acoustically coupled to a generally flat, honeycomb-type, metal diaphragm sheet material.

The acoustic transducer of the invention comprises a piezoelectric driving element which is acoustically coupled to a honeycomb-type diaphragm sheet material. The acoustic transducer so constructed, for example, with a honeycomb aluminum metal diaphragm material and a thin metal coupler, provides for an efficient, well-dispersed, frequency response without cavity or geometrical effects which are exhibited by cone-type or dome-type diaphragm transducer configurations. Further, the acoustic transducer may be constructed in extremely shallow designs; for example, in designs of less than ¼ of an inch. The acoustic transducer of the invention also provides for improved heat dissipation due to the high heat conductivity, where the honeycomb diaphragm material and coupling elements are composed of metal, such as of thin aluminum.

The acoustic transducer of the invention comprises a housing or frame element generally of dish-like construction, within which is disposed a piezoelectric driving element, typically circular or oval in form, a support means to secure one side of the piezoelectric element to the housing element, and an acoustical coupler, typically of a thin sheet material, of either an annular-ring, truncated-cone or other design or construction, secured to the opposite side of the piezoelectric driving element; for example, either peripherally or centrally disposed, and typically secured by adhesives, and a honeycomb diaphragm element characterized by a high stiffness-to-weight ratio, and generally a flat sheet composed of a heat-conductive metal, which honeycomb material is acoustically coupled to the opposite edge of the annular-ring coupler or to the larger diameter of the truncated-cone coupler.

The high-frequency speakers of the invention include a piezoelectric element which may comprise a monomorph or a wafer assembly, such as a bimorph, as desired. The piezoelectric element may be used in various shapes, but usually is employed in a circular or oval configuration. In one embodiment, the transducer of the invention provides for an acoustical output of over 80 decibels or more at over 2.0 kilohertz, such as over the range of 2.5 to 20 kilohertz.

The means employed to couple the piezoelectric element to the honeycomb diaphragm generally comprises a thin; for example, 2 to 40 mils, flat, sheet material preferably of heat-conductive metal, but which may be other material, such as paper or plastic material, to act as a coupler between the piezoelectric element and the honeycomb diaphragm. The acoustical coupling means provides coupling with the honeycomb diaphragm at the one end and also aids in providing support thereof, while the other edge receives acoustical signals from the piezoelectric element. Preferably, the coupling means is composed of the same or similar material as the honeycomb diaphragm material and preferably comprises a thin, heat-conductive material, such as brass, aluminum or other metal, while nonmetal materials include, but are not limited to: paper and plastic like nylon, polycarbonates, polypropylene and other materials used for acoustical coupling.

The coupling means is secured to and between the honeycomb diaphragm and the piezoelectric element, and usually such means to secure includes or comprises the use of resin material, such as resin adhesive material, such as hardenable epoxy and other resins.

The honeycomb diaphragm employed in the transducer of the invention comprises a thin material, particularly of metal, formed into a honeycomb-type structure, such as forming a plurality of adjacent thin-wall cells, particularly of a defined polygonical structure, such as of a hexagonal or octagonal nature. The honeycomb material should be characterized by a high stiffness-to-weight ratio, so that it enhances the acoustical energy from the coupling means. Typically, the honeycomb material is composed of a plurality of polygonal-shaped material having thin walls and covered by and secured to one or more layers of sheet material of the same or different material than the material forming the honeycomb structure.

Thus, in one embodiment, the honeycomb diaphragm may comprise a thin-wall, honeycomb structure secured, such as by an adhesive, to a single, flat, sheet material, or be secured to upper and lower, flat, sheet materials, particularly where the material is a thin, heat-conductive material, such as aluminum or an aluminum-alloy material. The honeycomb diaphragm is typically a flat diaphragm material; for example, less than about 1 inch in thickness; for example, less than ¼ of an inch in thickness, which permits the construction of high-frequency speakers of very shallow design, without sacrifice of acoustical output. The honeycomb material is used in a flat sheet form, but other forms may be used, such as dome or cone form, although such forms do not provide the advantage of shallow design. It is particularly preferred that the honeycomb diaphragm be composed of a flat sheet material of a thin upper and lower layer of aluminum, with an aluminum, polygonal, honeycomb structure therebetween, the honeycomb being substantially perpendicular to the thin layer material, to provide a lightweight structure of high strength and stiffness.

The invention will be described for the purpose of illustration only in connection with particular embodiments; however, it is recognized that various changes, modifications, additions and improvements may be made, all falling within the spirit and scope of the invention.

BRIEF DESCRIPTION OF THE DRAWINGS

FIG. 1 is a schematic cross-sectional view of an acoustic transducer of the invention;

FIG. 2 is a schematic cross-sectional view of another embodiment of an acoustic transducer of the invention;

FIG. 3 is a fragmentary, enlarged, partially cutaway, perspective view of the honeycomb material used in the acoustic transducer of the invention; and FIG. 4 is a graphical representation of the sound output in decibels versus the frequency response in hertz of an acoustic transducer of FIG. 1.

DESCRIPTION OF THE EMBODIMENTS

FIG. 1 shows a high-frequency speaker 10 of the invention having a dish-like, stamped, metal frame 12 and containing a monomorph or bimorph piezoelectric element 14 having a generally flat surface and being generally circular in shape. The piezoelectric element 14 is supported in a fixed position by a rigid, central, support post 16 centrally positioned in the interior of the dish-like frame 12. The support post is adhesively fixed to the bottom dish of the frame 12 and to the central area on one side of the piezoelectric element 14.

A thin-wall; for example, 2 to 5 mils, hollow cylinder of an aluminum, acoustical, coupling material 18 is employed as an acoustical coupling means, with one edge of the coupling material 18 adhesively secured; for example, by an epoxy resin, about the outer periphery of the upper major surface of the piezoelectric element 14. A flat sheet of about ¼ of an inch thickness; for example, ⅛ to ½ of an inch, of honeycomb material 22 is employed as a flat diaphragm, the honeycomb material composed of aluminum metal, which material is shown more particularly in FIG. 3. The honeycomb diaphragm 22 is generally circular in configuration and is of larger diameter than and acoustically positioned and coupled with the piezoelectric element 14 through being adhesively secured to the other upper edge of the coupling material 18. The honeycomb diaphragm 22 is surrounded, and the interior of the frame 12 is sealed from outside contamination, by the use of a flexible surrounding material 20, such as paper or aluminum, about and secured to the peripheral edges of the honeycomb diaphragm 22. The exterior of the frame 12 includes a flat, electric, insulating board 24 with electrical terminals 26, which terminals are electrically connected by electrical wires 28 to the piezoelectric element 14, so that electrical energy may be imported to or received from the piezoelectric element 14.

FIG. 2 shows another embodiment of an acoustic transducer 30 of similar construction as the speaker of FIG. 1, except that the coupling means comprises a truncated, conical element 38, and the piezoelectric element 34 is flexibly supported at its outer peripheral edges by a surrounding, flexible, support material 36. The truncated, conical coupler is adhesively secured at the smaller-diameter edge to one surface of the piezoelectric element 34, while the other edge is adhesively secured to the honeycomb diaphragm 42. The honeycomb diaphragm 42 is secured to and surrounded by a flexible surrounding material 40 to the frame 32. The piezoelectric element 34, rather than being centrally and rigidly supported, is peripherally supported and spaced apart from the interior back surface of the frame 32 by a flexible surrounding material 36 adhesively secured at its outer edges to the interior of the frame 32 and the piezoelectric element 34. The transducer 30 includes an insulating board 44, electrical terminals 46 and electrical wires 48. Optionally, the devices 10 and 30 may be enhanced in output by coupling acoustically by adhesives the exterior edges of the other exterior surface of the honeycomb diaphragm 22 or 42 with an acoustical horn 56, such as a truncated cone or parabolic horn, to enhance the sound output.

FIG. 3 shows a preferred honeycomb material useful as the honeycomb diaphragm in FIGS. 1 and 2, wherein the honeycomb material comprises a thin upper 52 and thin lower 50 layer of aluminum metal laminated to a plurality of honeycomb-like cells 54 of hexagonal shape made of thin aluminum, with all the thin walls being disposed generally perpendicular to the upper and lower layers 52 and 50. The material 22 may vary in thickness, but typically ranges from about 1/16 of an inch to 1 inch; for example, ⅛ of an inch to ½ of an inch in thickness. The size and shape of the open cells which make up the honeycomb may vary, but typically are polygonal and range in width and length from ⅛ of an inch to 1 inch; for example, ¼ to ½ of an inch. The honeycomb material has a high stiffness-to-weight ratio. One form of honeycomb material suitable for use in the invention comprises honeycomb manufactured by Hexcel Corporation of Dublin, Calif., with the cell of about 3/16 inches in size and the honeycomb material having a 0.9 mil. aluminum upper and lower skin layer and the hexogonal cell formed of 0.7 mil. aluminum with an overall plate or honeycomb thickness of 0.062 inches. The honeycomb material had a stiffness such that in a 4-inch span with a 0.07 psi load, the deflection of the material was 0.012 inches.

FIG. 4 shows a graphical representation of a frequency-response curve employing the transducer illustrated in FIG. 1. The first peak is relatively insignificant in sound output and arises from resonance of the honeycomb material, which peak if desired can be removed, modulated or dampened by dampening the honeycomb material preferably, for cosmetic reason, by a dampening material on the interior side of the honeycomb material. The second peak is significant and shows an average sound decibel of 95. over the range of about 8.5 KH to 16 KH while exhibiting a flat response over the 0.2 to 2.2 KH range. The responsive curve is based on the FIG. 1 device wherein the flexible surrounding material comprises Mylar, a polyester film, and the coupling means is on 3 mil. aluminum cylinder of 44 mm. diameter and 2 mm. height, the piezoelectric element is a bimorph TDK Corporation of Japan element with a diameter of 21 mm. The input was 2.83 volts with the microphone at 0.5 meter distance. The aluminum honeycomb diaphragm was 23 mm. in diameter with a thickness of about 0.062 inches.

The transducer so described provides for a shallow design, good heat dissipation and good sound vs. frequency reponse.

What we claim is:

1. An acoustic transducer which comprises:
(a) a piezoelectric element to convert stimuli between electrical and acoustical energy states, the piezoelectric element characterized by a major surface on one or the other side of the piezoelectric element;
(b) means to support the piezoelectric element;
(c) conductive means to provide or receive electrical stimuli to or from the piezoelectric element;
(d) a coupling means which comprises a sheet material peripherally secured at the one edge thereof to the one major surface of the piezoelectric element in an acoustically coupled relationship with the major surface of the piezoelectric element; and
(e) a generally honeycomb sheet diaphragm material having a one and another side, the diaphragm material having a high stiffness-to-weight ratio and capable of acoustical vibration generally in a piston-type mode, the one side of the diaphragm material secured to the other peripheral edge of the sheet material of the coupling means, the honeycomb diaphragm material spaced apart from the piezoelectric element by the coupling means and acoustically coupled thereto by the other edge of the coupling means.

2. The transducer of claim 1 wherein the piezoelectric element comprises a monomorph or bimorph element having a generally circular or oval shape.

3. The transducer of claim 1 which includes a dish-like housing element, and wherein the support means is secured within and to one surface of the housing element and to the other side of the major surface of the piezoelectric element.

4. The transducer of claim 3 wherein the support means comprises a generally centrally positioned, rigid support secured on one surface centrally to the other major surface of the piezoelectric element, and the other surface secured to the housing element.

5. The transducer of claim 3 wherein the support means comprises an annular peripheral ring of flexible support material secured at the one inner edge peripherally to the peripheral outer edge of the piezoelectric element and at the outer edge of the ring to the housing element, to provide a flexible support for the piezoelectric element within the housing.

6. The transducer of claim 1 wherein the coupling means comprises a heat-conductive, thin, flat-sheet, metal material.

7. The transducer of claim 1 wherein the honeycomb diaphragm material comprises a thin, heat-conductive, sheet metal material.

8. The transducer of claim 1 wherein the coupling means and the honeycomb diaphragm means are both composed of the same heat-conductive, sheet metal material.

9. The transducer of claim 1 wherein the coupling means comprises an upwardly extending, circular ring of thin sheet material adhesively secured at the one end edge about the peripheral edge of the major surface of the piezoelectric element and adhesively secured at the other edge to the inner other side of the honeycomb diaphragm material.

10. The transducer of claim 1 wherein the coupling means comprises a truncated cone composed of a thin sheet material, the smaller diameter portion of the truncated cone peripherally secured adhesively about its periphery to the major surface of the piezoelectric element, and the portion of the truncated cone adhesively secured about its periphery to the inner other side of the honeycomb diaphragm material.

11. The transducer of claim 1 which includes a horn element and means to secure the horn element in an acoustically coupled relationship on the one side of the honeycomb diaphragm material, to enhance the acoustical response of the transducer.

12. The transducer of claim 1 wherein the honeycomb diaphragm material is composed of a material selected from the group consisting of a carbon-fiber-reinforced polymer, a glass-reinforced polymer, a polymer material, a metal and a paper material.

13. The transducer of claim 1 wherein the piezoelectric element has a generally circular shape, the honeycomb diaphragm material has a generally circular shape of greater diameter than the piezoelectric element, and wherein the coupling means comprises an annular ring of material acoustically coupled at one edge with the piezoelectric element at its peripheral edge, and at the other edge to the honeycomb diaphragm material, and the piezoelectric element is centrally positioned relative to the honeycomb diaphragm material.

14. The transducer of claim 1 wherein the piezoelectric element has a generally circular shape, the honeycomb diaphragm material has a generally circular shape of greater diameter than the piezoelectric element, and wherein the coupling means comprises a truncated cone, wherein the minor diameter section of the truncated cone is centrally secured to the piezoelectric element and the major diameter portion of the truncated cone is centrally positioned to the honeycomb diaphragm material.

15. The transducer of claim 1 wherein the honeycomb diaphragm material comprises a thin material having a thin inner and outer layer of sheet material, between which is secured a thin material characterized by a plurality of polygonical cells and is generally perpendicular to the inner and other layers.

16. The transducer of claim 15 wherein the thin material comprises aluminum, the honeycomb pattern being of a hexagonal or octagonal shape 17. The transducer of claim 1 characterized in that the transducer comprises flat honeycomb material having a thickness of about $\frac{1}{8}$ to $\frac{1}{2}$ inch and the coupling means comprises a sheet material of from about 2 to 40 mils.

18. The transducer of claim 1 wherein the transducer is characterized by an average sound output in decibels of 95 or more over the frequency range of 8.5 to 16 kilohertz.

19. An acoustic transducer, which transducer comprises:
(a) a generally circular-shaped, piezoelectric, monomorph or bimorph element to convert stimuli between electrical and acoustical energy states, the piezoelectric element characterized by a major surface on one or the other side;
(b) a dish-like housing element;
(c) a support post means generally centrally secured to the housing element and centrally secured to the piezoelectric element, to support the piezoelectric element within the housing element;
(d) an electrically conductive means to provide electrical stimuli to the piezoelectric element;
(e) a coupling means which comprises a thin metal sheet material forming a generally annular ring and at one edge peripherally secured by an adhesive to the one major surface of the piezoelectric element in an acoustically coupled relationship with the major surface of the piezoelectric element; and (f) a generally circular, flat, stiff, honeycomb diaphragm material having a one and another side and characterized by a high stiffness-to-weight ratio and composed of a thin, heat-conductive metal, the one side of the diaphragm material secured to the other peripheral edge of the annular ring of the coupling means, the flat honeycomb diaphragm material spaced apart a slight distance from the one major surface of the piezoelectric element by the coupling means and acoustically coupled thereto.

20. An acoustic transducer, which transducer comprises:

(a) a generally circular-shaped, piezoelectric, monomorph or bimorph element to convert stimuli between electrical and acoustical energy states, the piezoelectric element characterized by a major surface on one or the other side;

(b) a dish-like housing element;

(c) a flexible support means which comprises a ring of flexible sheet material, one outer edge adhesively secured to the housing element and the other inner edge peripherally adhesively secured about the piezoelectric element to support the piezoelectric element;

(d) an electrically conductive means to provide electrical stimuli to the piezoelectric element;

(e) a coupling means which comprises a thin metal sheet material forming a generally truncated conical element and at the one edge minor-diameter section peripherally secured by an adhesive centrally to the one major surface of the piezoelectric element in an acoustically coupled relationship with the major surface of the piezoelectric element; and (f) a generally circular, flat, stiff, honeycomb diaphragm material having a one and another side and characterized by a high stiffness-to-weight ratio and composed of a thin, heat-conductive metal, the one side of the diaphragm material centrally secured to the other peripheral edge of the major-diameter section of the conical element of the coupling means, the flat honeycomb diaphragm material spaced apart a slight distance from the one major surface of the piezoelectric element by the coupling means and acoustically coupled thereto.

* * * * *